US009737095B1

(12) United States Patent
Kitelinger

(10) Patent No.: US 9,737,095 B1
(45) Date of Patent: Aug. 22, 2017

(54) MULTI-LAYERED MATERNITY BAND

(71) Applicant: Luke Kitelinger, Charlottesville, VA (US)

(72) Inventor: Luke Kitelinger, Charlottesville, VA (US)

( * ) Notice: Subject to any disclaimer, the term of this patent is extended or adjusted under 35 U.S.C. 154(b) by 0 days.

(21) Appl. No.: 15/063,685

(22) Filed: Mar. 8, 2016

(51) Int. Cl.
*A41C 1/10* (2006.01)
*H04R 1/28* (2006.01)
*H04R 1/02* (2006.01)
*H04R 1/32* (2006.01)

(52) U.S. Cl.
CPC ..... *A41C 1/10* (2013.01); *H04R 1/028* (2013.01); *H04R 1/28* (2013.01); *H04R 1/323* (2013.01)

(58) Field of Classification Search
CPC ..... A41C 1/10
USPC ..... 2/48; 24/593.1; 181/126; 381/109, 151, 381/333, 77, 301, 332; 434/236, 319, 434/922; 600/27, 28, 591; 602/19; 190/115
See application file for complete search history.

(56) References Cited

U.S. PATENT DOCUMENTS 4,798,539 A * 1/1989 Henry ..... A61H 23/0236 224/236
4,830,007 A * 5/1989 Stein ..... G09B 19/00 381/151
4,934,998 A * 6/1990 Thomas, Jr. ..... A61B 8/0866 600/27
5,109,421 A * 4/1992 Fox ..... H04R 1/02 2/338
5,420,581 A 5/1995 Peters
5,491,756 A * 2/1996 Francais ..... H04R 5/023 381/332
5,532,681 A 7/1996 Peters
5,699,558 A * 12/1997 Min ..... H04R 5/023 2/338
5,873,736 A * 2/1999 Harrison ..... H04R 5/023 224/664
D407,623 S 4/1999 Romo
5,898,787 A * 4/1999 Stanford ..... H04R 5/023 224/910
5,913,834 A * 6/1999 Francais ..... H04R 5/023 600/591
6,097,822 A * 8/2000 Min ..... H04R 5/023 2/102
6,169,814 B1 * 1/2001 Johnson ..... H04R 5/023 381/333

(Continued)

FOREIGN PATENT DOCUMENTS

FR 2989867 A1 3/2013

*Primary Examiner* — Gerald Gauthier
(74) *Attorney, Agent, or Firm* — Kyle A. Fletcher, Esq.

(57) ABSTRACT

The multi-layered maternity band is an apparel item that is adapted for use during maternity. The multi-layered maternity band is a band that is worn around the enlarged abdomen of pregnant women. The multi-layered maternity band is a textile formed from sound absorbing material that protects the infant from exposure to exterior sounds. The multi-layered maternity band is further fitted with speakers that allows for the further use of sound cancelling technology or the playing of music for the infant. The multi-layered maternity band comprises a band, a first hook and loop fastener, a second hook and loop fastener, a pocket, a first speaker, a second speaker, and a signal cable.

19 Claims, 3 Drawing Sheets

(56) References Cited

U.S. PATENT DOCUMENTS

| | | | | |
|---|---|---|---|---|
| 6,206,821 | B1 * | 3/2001 | Rhee | A61B 5/048 600/26 |
| 6,840,775 | B2 * | 1/2005 | Sailors | G09B 19/00 434/236 |
| 6,949,074 | B2 | 9/2005 | Fatemi | |
| 8,121,305 | B2 * | 2/2012 | Servello | H04R 1/02 381/77 |
| 8,194,891 | B2 * | 6/2012 | Godart | A61M 21/02 381/109 |
| 9,293,059 | B1 * | 3/2016 | Jones | G09B 5/04 |
| 9,526,275 | B2 * | 12/2016 | Geymayr | A41C 1/10 |
| 2002/0196959 | A1 * | 12/2002 | Gurner | H04R 5/023 381/333 |
| 2003/0016840 | A1 * | 1/2003 | Sica | H04R 5/02 381/333 |
| 2008/0029333 | A1 * | 2/2008 | Oz | A41D 1/005 181/126 |
| 2011/0088987 | A1 * | 4/2011 | Santy | A45C 5/14 190/115 |
| 2011/0118640 | A1 * | 5/2011 | Pollack | A61F 5/028 602/19 |
| 2016/0031413 | A1 * | 2/2016 | Carlsson | A44B 11/2507 24/593.1 |

* cited by examiner

MULTI-LAYERED MATERNITY BAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of maternity corsets, more specifically, a sound-absorbing belt adapted for use in maternity.

SUMMARY OF INVENTION

The multi-layered maternity band is an apparel item that is adapted for use during maternity. The multi-layered maternity band is a band that is worn around the enlarged abdomen of pregnant women. The multi-layered maternity band is a textile formed from sound absorbing material that protects the infant from exposure to exterior sounds. The multi-layered maternity band is further fitted with speakers that allows for the further use of sound cancelling technology or the playing of music for the infant.

These together with additional objects, features and advantages of the multi-layered maternity band will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-layered maternity band in detail, it is to be understood that the multi-layered maternity band is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-layered maternity band.

It is therefore important that the claims be regarded as including such equivalent construction insofar as they do not depart from the spirit and scope of the multi-layered maternity band. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
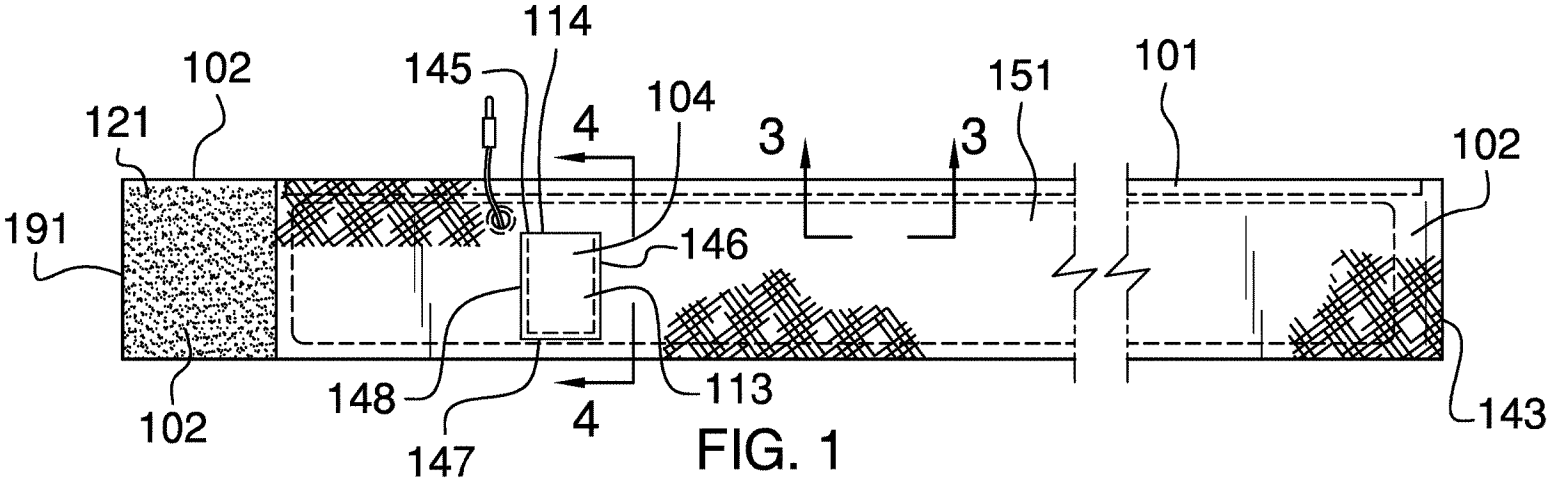
FIG. 1 is a front view of an embodiment of the disclosure.
Figure 2:
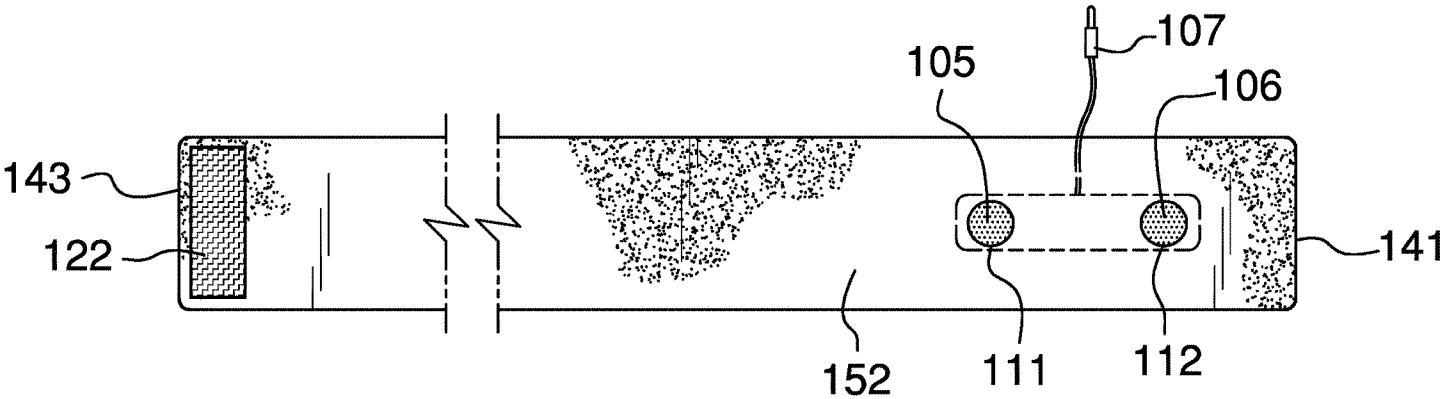
FIG. 2 is a back view of an embodiment of the disclosure.
Figure 3:
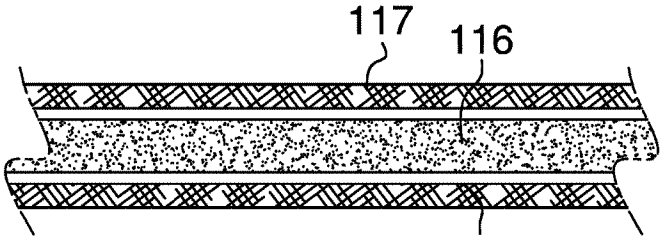
FIG. 3 is a cross-sectional view of an embodiment of the disclosure across 3-3 in FIG. 1.
Figure 4:
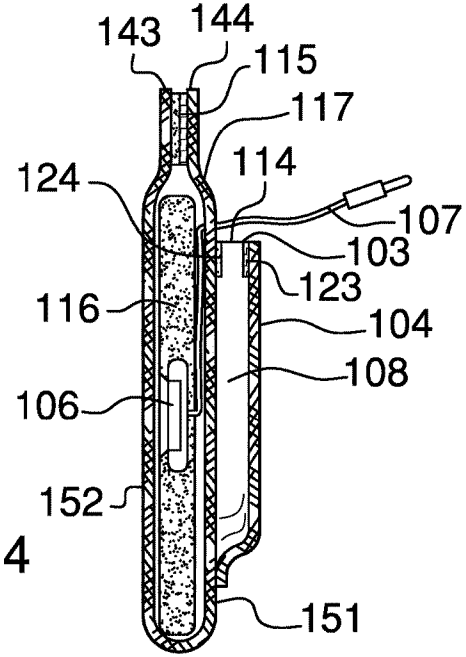
FIG. 4 is a cross-sectional view of an embodiment of the disclosure across 4-4 in FIG. 1.
Figure 5:
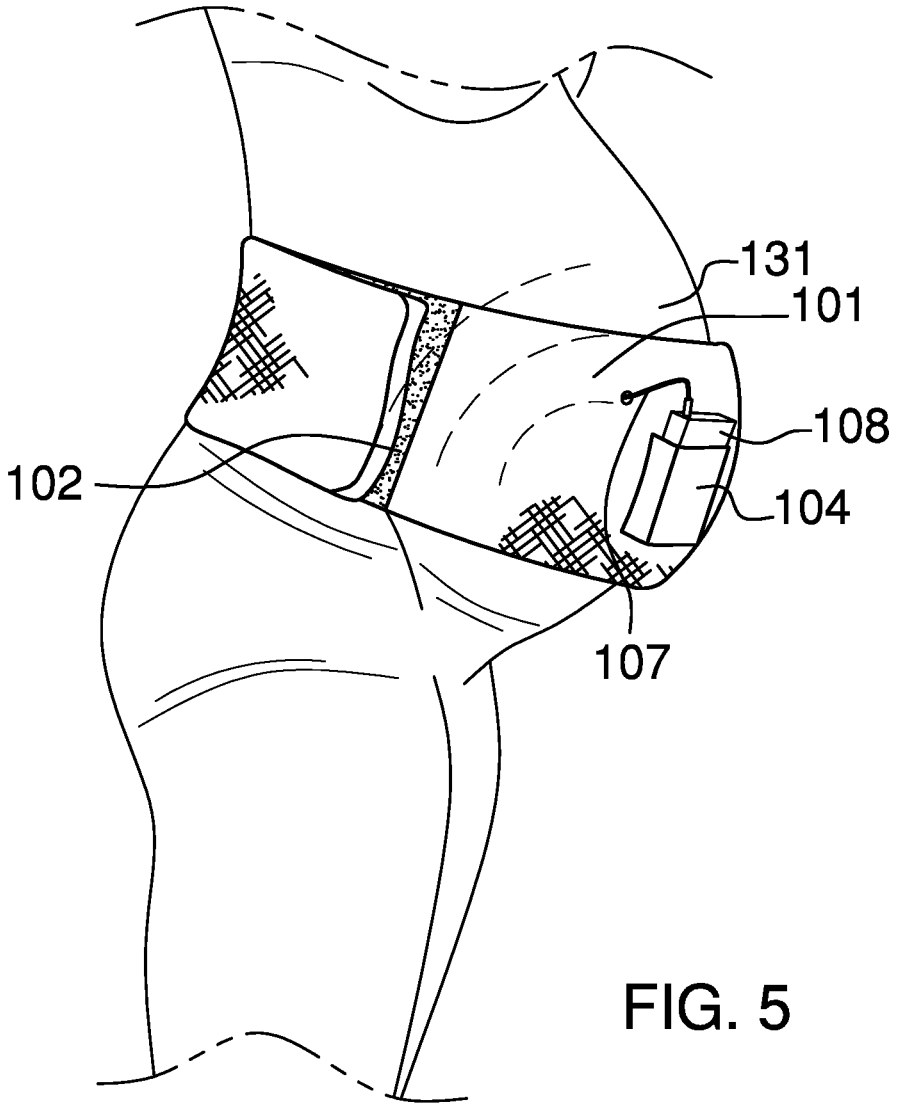
FIG. 5 is an in use view of an embodiment of the disclosure.

Detailed reference will now be made to a first potential embodiment of the disclosure, which is illustrated in FIGS. 1 through 5.

The multi-layered maternity band 100 (hereinafter invention) comprises a band 102, a first hook and loop fastener 102, a second hook and loop fastener 103, a pocket 104, a first speaker 105, a second speaker 106, and a signal cable 107. The invention 100 is an apparel item that is adapted for use during maternity. The invention 100 is a band that is worn around the enlarged abdomen 101 of pregnant women. The invention 100 is a textile formed from sound absorbing material that protects the infant from exposure to exterior sounds. The invention 100 is further fitted with a plurality of speakers that allows for the further use of sound cancelling technology or the playing of music for the infant.

The band 101 is formed from a first textile 117 that is further defined with a first edge 141, a second edge 142, a third edge 143, a fourth edge 144. The span of the first edge 141 is identical to the span of the third edge 143. The span of the second edge 142 is identical to the span of the fourth edge 144. The span of the first edge 141 is less than the span of the second edge 142. The band 101 is formed by joining the second edge 142 of the first textile 117 and the fourth edge 144 of the first textile 117 using a third hook and loop fastener 115. The interior space formed by joining the second edge 142 of the first textile 117 and the fourth edge 144 of the first textile 117 is filled with a padded material 116 that is designed to absorb sound.

Once formed, the band 101 is further defined with a first surface 151 and a second surface 152. The second surface 152 of the band 101 is proximal to the enlarged abdomen 131 when the invention 100 is worn normally. The first surface 151 is the surface of the band 101 that is distal from the second surface 152. In the first potential embodiment of the disclosure, the band 101 is formed with a plurality of elastic yarns, which allow the band 101 to be stretched and adjusted to provide a comfortable fit around the enlarged abdomen 131.

The first hook and loop fastener 102 attaches the first end 141 of the band 101 to the third end 143 of the band 101 to hold the band 101 in position around the enlarged abdomen 131. The first hook and loop fastener 102 further comprises a first hook or loop surface 121 and a second hook or loop surface 122. The first hook or loop surface 121 attaches to the first end 141 of the band 101. The second hook or loop surface 122 attaches to the third end 143 of the band 101. To attach the first end 141 to the third end 143, the second hook or loop surface 122 is pressed against the first hook or loop surface 121.

The pocket 104 is a pouch that is formed from a second textile 113. The second textile 113 attaches to the first surface 151 of the band 101 using a plurality of sewn seams. The second textile 113 further comprises a fifth edge 145, a sixth edge 146, a seventh edge 147 and an eighth edge 148. The second textile 113 attaches to the first surface 151 of the band 101 using a plurality of sewn seams. The plurality of sewn seams attaches the sixth edge 146, the seventh edge 147 and the eighth edge 148 to the first surface 151 of the band 101. The space between the fifth edge 145 and the first surface 151 forms an opening 114 through which an electronic device 108 can be inserted. The electronic device 108 is discussed elsewhere in this disclosure.

The second hook and loop fastener 103 is used to open and close the opening 114. The second hook and loop fastener 103 further comprises a third hook or loop surface 123 and a fourth hook or loop surface 124. The third hook or loop surface 123 is placed along the fifth edge 145 of the second textile 113. The fourth hook or loop surface 124 is placed on the first surface 151 of the band 101 in a position corresponding to the fifth edge 145 of the second textile 113. To secure the electronic device 108 in the pocket 104, the pocket 104 is closed via pressing the third hook or loop surface 123 against the fourth hook or loop surface 124.

The second surface 152 of the band 101 further comprises a first speaker opening 111 and a second speaker opening 112. Methods to form openings in textiles are well known and documented in the sewing arts.

The first speaker 105 and the second speaker 106 are each a commercially available speaker. The first speaker 105 is mounted within the first speaker opening 111 such that the acoustic energy projected from the first speaker 105 is directed towards the enlarged abdomen 131. The second speaker 106 is mounted within the second speaker opening 112 such that the acoustic energy projected from the second speaker 106 is directed towards the enlarged abdomen 131. Methods to attach electronic components to textiles require techniques similar to the attachment of findings to textiles. These techniques are well known and documented in the sewing arts.

The signal cable 107 attaches the first speaker 105 and the second speaker 106 to the electronic device 108. The signal cable 107 is a collection of insulated wires that are used to transmit an electrical signal from the electronic device 108 to the first speaker 105 and the second speaker 106. Signal cables 107 are commercially available and their use is well known and documented in the electrical arts.

To use the invention 100, the band 101 is wrapped around the extended abdomen 131 and fixed into position using the first hook and loop fastener 102. The band 101 is positioned such that the first speaker 105 and the second speaker 106 face the extended abdomen 131. The electronic device 108 is an audio source that can be a commercially available music player that plays audio files, a commercially available white noise generator, or a commercially available noise cancelling system. The electronic device 108 is placed into the pocket 104 and the signal cable 107 is connected to the electronic device 108. The electronic device 108 then generates and transmits the electrical signal that is used by the first speaker 105 and the second speaker 106 to create an audible sound.

The following definitions were used in this disclosure:

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted in to audible sounds by a speaker.

Elastic: As used in this disclosure, an elastic is a material or object that deforms when a force is applied to it and that is able to return to its original shape after the force is removed.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Fastener: As used in this disclosure, a fastener is a device that is used to join or affix two objects. Fasteners generally comprise a first part which is attached to the first object and a second part which is attached to the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook or loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Pad: As used in this disclosure, a pad is a mass of soft material used as a filling or for protection against damage or injury.

Pocket: As used in this disclosure, a pocket is a small pouch that is formed into an object. Pockets are often formed by joining a second textile or a second sheeting to a first textile or a first sheeting, respectively, by sewing or heat sealing respectively.

Sewn Seam: As used in this disclosure, a sewn seam a method of attaching two or more layers of textile, leather, or other material through the use of a thread, a yarn, or a cord that repeatedly inserted and looped through the two or more layers of textile, leather, or other material.

Speaker: As used in this disclosure, the term a speaker is an electrical device that converts an electrical signal into an audible sound.

Strip: As used in this disclosure, the term describes a long thin object of uniform width. Strips are often rectangular in shape.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed via cutting broader materials into strips.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparel item comprising:

a band, a first hook and loop fastener, a second hook and loop fastener, a pocket, a first speaker, a second speaker, and a signal cable;

wherein the apparel item that is adapted for use during maternity;

wherein the apparel item is a band that is worn around the enlarged abdomen of pregnant women;

wherein the apparel item further comprises sound absorbing material that protects the infant from exposure to exterior sounds;

wherein the apparel item is adapted for use with an electronic device;

wherein the apparel item receives an electrical signal from the electronic device and uses the electrical signals to generates audible sounds;

wherein the band is formed from a first textile;

wherein the first textile is further defined with a first edge, a second edge, a third edge, a fourth edge.

2. The apparel item according to claim 1 wherein the band is formed by joining the second edge of the first textile and the fourth edge of the first textile.

3. The apparel item according to claim 2 wherein the interior space formed by joining the second edge of the first textile and the fourth edge of the first textile is filled with a padded material.

4. The apparel item according to claim 3 wherein the padded material is designed to absorb sound.

5. The apparel item according to claim 4 wherein the band is further formed with a plurality of elastic yarns;

wherein the band is further defined with a first surface and a second surface.

6. The apparel item according to claim 5 wherein the first hook and loop fastener holds the band to the abdomen.

7. The apparel item according to claim 6 wherein the first hook and loop fastener attaches the first end of the band to the third end of the band.

8. The apparel item according to claim 7 wherein the pocket is a pouch that is formed from a second textile.

9. The apparel item according to claim 8 wherein the second textile attaches to the first surface of the band using a plurality of sewn seams;

wherein the second textile further comprises a fifth edge, a sixth edge, a seventh edge and an eighth edge.

10. The apparel item according to claim 9 wherein the space between the fifth edge and the first surface forms an opening through which the electronic device can be inserted.

11. The apparel item according to claim 10 wherein the second hook and loop fastener is used to open and close the opening.

12. The apparel item according to claim 11 wherein the second surface of the band further comprises a first speaker opening and a second speaker opening.

13. The apparel item according to claim 12 wherein the first speaker is mounted within the first speaker opening such that the acoustic energy projected from the first speaker is directed towards the enlarged abdomen.

14. The apparel item according to claim 13 wherein the second speaker is mounted within the second speaker opening such that the acoustic energy projected from the second speaker is directed towards the enlarged abdomen.

15. The apparel item according to claim 14 wherein the signal cable attaches the first speaker to the electronic device;

wherein the signal cable attaches the second speaker to the electronic device.

16. The apparel item according to claim 1 wherein the band further comprises a padded material that is designed to absorb sound;

wherein the padded material is designed to absorb sound.

17. The apparel item according to claim 16 wherein the first hook and loop fastener holds the band to the abdomen.

18. The apparel item according to claim 17 wherein the pocket is a pouch that is formed from a second textile;

wherein the pocket is adapted to store the electronic device;

wherein the second hook and loop fastener is used to open and close the opening.

19. The apparel item according to claim 18 wherein the band further comprises a first speaker opening and a second speaker opening;

wherein the first speaker is mounted within the first speaker opening such that the acoustic energy projected from the first speaker is directed towards the enlarged abdomen;

wherein the second speaker is mounted within the second speaker opening such that the acoustic energy projected from the second speaker is directed towards the enlarged abdomen;

wherein the signal cable attaches the first speaker to the electronic device;

wherein the signal cable attaches the second speaker to the electronic device.

* * * * *